US006394841B1

(12) United States Patent
Matsuura

(10) Patent No.: US 6,394,841 B1
(45) Date of Patent: May 28, 2002

(54) ELECTRIC CONNECTOR HAVING SHIELD PLATES

(75) Inventor: Masanori Matsuura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/247,906

(22) Filed: Feb. 11, 1999

(30) Foreign Application Priority Data

Feb. 16, 1998 (JP) ..... 10-048573

(51) Int. Cl.[7] ..... H01R 13/58
(52) U.S. Cl. ..... 439/607
(58) Field of Search ..... 439/607, 660, 439/570, 108, 95, 101, 358

(56) References Cited

U.S. PATENT DOCUMENTS

| | | | | |
|---|---|---|---|---|
| 4,687,263 A | | 8/1987 | Cosmos | |
| 5,035,631 A | | 7/1991 | Piorunneck | |
| 5,626,500 A | * | 5/1997 | Yoshimura | 439/862 |
| 5,697,799 A | | 12/1997 | Consoli | |
| 5,921,814 A | * | 7/1999 | Maruyama | 439/607 |
| 6,042,398 A | * | 3/2000 | Wu et al. | 439/101 |

FOREIGN PATENT DOCUMENTS

| | | | |
|---|---|---|---|
| EP | 0774806 | | 5/1997 |
| EP | 0793312 | | 9/1997 |
| EP | 0 808 520 B1 | * | 11/1997 |
| JP | 61-9789 | | 1/1986 |
| JP | 08222324 | | 8/1996 |
| JP | 8-279380 | | 10/1996 |
| JP | 9-17511 | | 1/1997 |
| WO | WO 9624969 | | 8/1996 |
| WO | WO 9628006 | | 9/1996 |

* cited by examiner

*Primary Examiner*—Gary Paumen
*Assistant Examiner*—Ann McCamey
(74) *Attorney, Agent, or Firm*—Kanesaka & Takeuchi

(57) ABSTRACT

An electrical connector comprises an insulative housing (1) of a rectangular paralellepiped, a plurality of contact elements (2) installed on both sides of the housing, a pair of shield plates (7) provided on longitudinal sides of the housing and a pair of reinforcing plates (15) provided on ends of the housing and each having a fixing leg, wherein ends of the reinforcing plate contact ends of the shield plate. The shield plate is positioned within the length of the housing, and the reinforcing plates comprises a main part provided at the ends of the housing and an auxiliary parts bent in parallel with the side surfaces of the shield plates, wherein the auxiliary parts overlap the ends of the shield plate to make spring contact with the shield plate.

1 Claim, 12 Drawing Sheets

ELECTRIC CONNECTOR HAVING SHIELD PLATES

BACKGROUND OF THE INVENTION

1. Field of the Invention

The present invention relates to electrical connectors having shield plates.

2. Description of the Related Art

Japanese patent application Kokai No. 8-279380 discloses a connector of this type. This connector comprises a plurality of shield plates on a pair of longitudinal sides of an insulative housing and a plurality of reinforcing plates made of metal on a pair of ends of the housing. The shield plates are longer than the housing and both ends thereof project beyond the housing in the longitudinal direction of the housing. The projecting ends of the shield plate are bent toward ends of the housing and contact the reinforcing plates for electrical connection to the reinforcing plates. Each reinforcing plate is provided with a fixing leg to firmly fix the connector to a circuit board.

There are a plurality of elongated windows provided along an upper end of the shield plate. A beam portion is formed between both ends of the window and the upper end of the shield plate. The beam portion is flexible in the direction of a thickness of the shield plate. A contact section or a dimple is provided in the middle of the beam portion to make spring contact with the shield plate of a mating connector.

The connector described above is provided with a large number of contact elements which are arranged with a certain pitch in the longitudinal direction of the housing. This pitch becomes smaller as the number of contact elements arranged in the housing increases. A plurality of ground legs are provided in the longitudinal direction of the shield plate at appropriate intervals. The ground legs are arranged such that each leg falls between two adjacent contact elements. Accordingly, the interval between the ground leg and the adjacent contact elements is very small. According to the above patent 8-279380, the ends of the shield plate are bent toward the ends of the housing and contact the reinforcing plates. Therefore, the bent position of the shield plate controls the relative position of the shield plate in the longitudinal direction of the housing. Accordingly, if the bent position is not accurate, there is an error in the position of the ground legs, which may cause the ground legs to be excessively close to or in contact with the contact elements. The error of the bent position is easily produced since the bending is usually done by pressing.

Some connectors have a structure similar to the above connector but a different number of contact elements in accordance with user's choice. The housings of these connectors have the same structure in the cross-section perpendicular to the longitudinal direction but different dimensions in the longitudinal direction. A housing having more contact elements is long and a housing having less contact elements is short. The shield plate is cut to a length corresponding to the length of the housing and bent at positions of its ends. Consequently, a different shield plate needs a different press dice.

As described above, the contact section or a dimple provided on the shield plate is located in the middle of the beam portion formed between the both ends of the window and the upper ends of the shield plate. The contact section is brought into spring contact with the shield section of a mating connector. Such spring property is provided by only the spring property of the beam portion and not satisfactory.

SUMMARY OF THE INVENTION

Accordingly, it is an object of this invention to provide an electrical connector having shield plates, wherein the positions of the shield plates are very accurate in the longitudinal direction in relation to the positions of the contact elements, and the same press die is used for the shield plates regardless of a number of contact elements or a length of the housing.

It is another object of this invention to provide an electrical connector, wherein the contact section of the shield plate is so flexible that it is possible to connect the shield plate to the shield section of a mating connector.

An electrical connector according to the invention comprises an insulative housing of a rectangular parallelepiped having a plurality of contact elements aligned in the housing and a pair of shield plates provided on a pair of longitudinal sides of the housing.

To achieve the first object of the invention, the electrical connector comprises a pair of shield plates provided on opposite sides of the housing and a pair of reinforcing plates at opposite ends of the housing, wherein ends of the reinforcing plates and ends of the shield plates contact each other.

According to the first embodiment of this invention to achieve the first object, the shield plate are positioned within the length of the housing and the reinforcing plate comprises a main part provided at an end of the housing and an auxiliary part bent such that the bent part is in parallel with the shield plate and overlaps an end of the shield plate, thereby making spring contact with the shield plate.

The another object of this invention is achieved by a second embodiment of this invention, wherein the shield plate comprises a contact tongue having at least one flexible portion near the base of the contact tongue such that the shield plate is sufficiently flexible to make spring contact with the contact section of a mating connector.

According to the first embodiment, the shield plate is positioned within the length of the housing in the longitudinal direction and has no end portion bent toward the end of the housing to prevent movement of the shield plate in the longitudinal direction. Accordingly, the position of the shield plate in the longitudinal direction is controlled only by engagement of an engaging part or a cut portion of the shield plate with a projection provided on the housing. A relative position of the engaging part and the ground section of the shield plate is very accurate since the both are produced by the same press-punching process. The accuracy of relative positions of the ground section and the contact element is determined by the relative positions of the contact element and the engaging section. The relative positions of the contact element and the engaging section are very accurate since the accommodation groove and the projection described above are formed by the same molding process. Accordingly, the relative positions of the ground section and the contact element are determined very accurately since the shield plate has no end portion bent toward the end of the housing.

As described above, the shield plate according to the first embodiment has no end portion bent toward the end of the housing so that it is possible to cut the shield plate to a length corresponding to the length of the housing which is determined by the number of the contact elements included therein. In other words, if a long semi-finished material is prepared, any size of shield plate is available by cutting the semi-finished material to a necessary length corresponding the length of the housing.

According to the second embodiment, the contact tongue is flexible since it has a U-shaped flexible portion. In addition, there is an additional flexible portion provided near the base of the contact tongue so that the contact tongue is very flexible to make spring contact with the shield section of a mating connector.

DESCRIPTION OF THE PREFERRED EMBODIMENT

Figure 1:
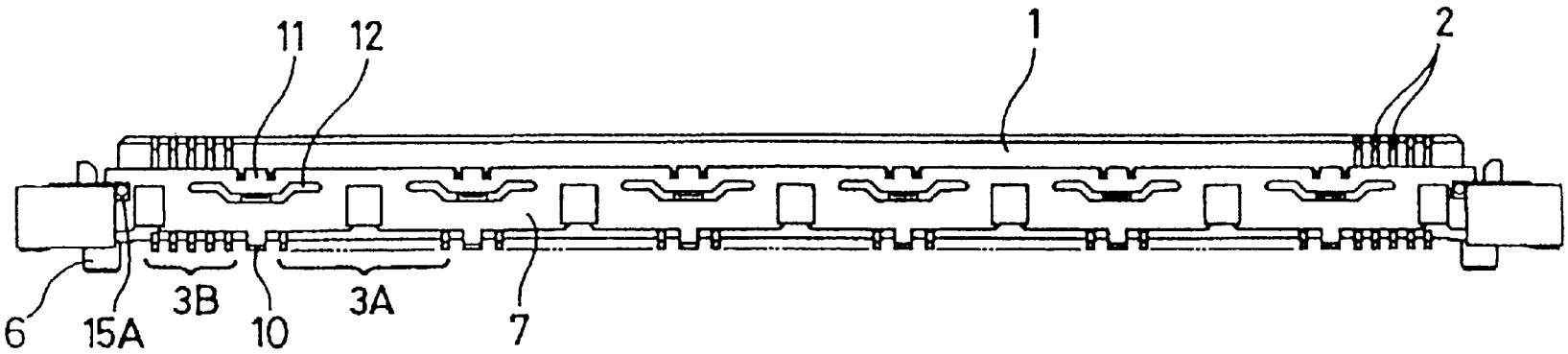
FIG. 1 is a front view of a connector according to a first embodiment of the invention.
Figure 2:
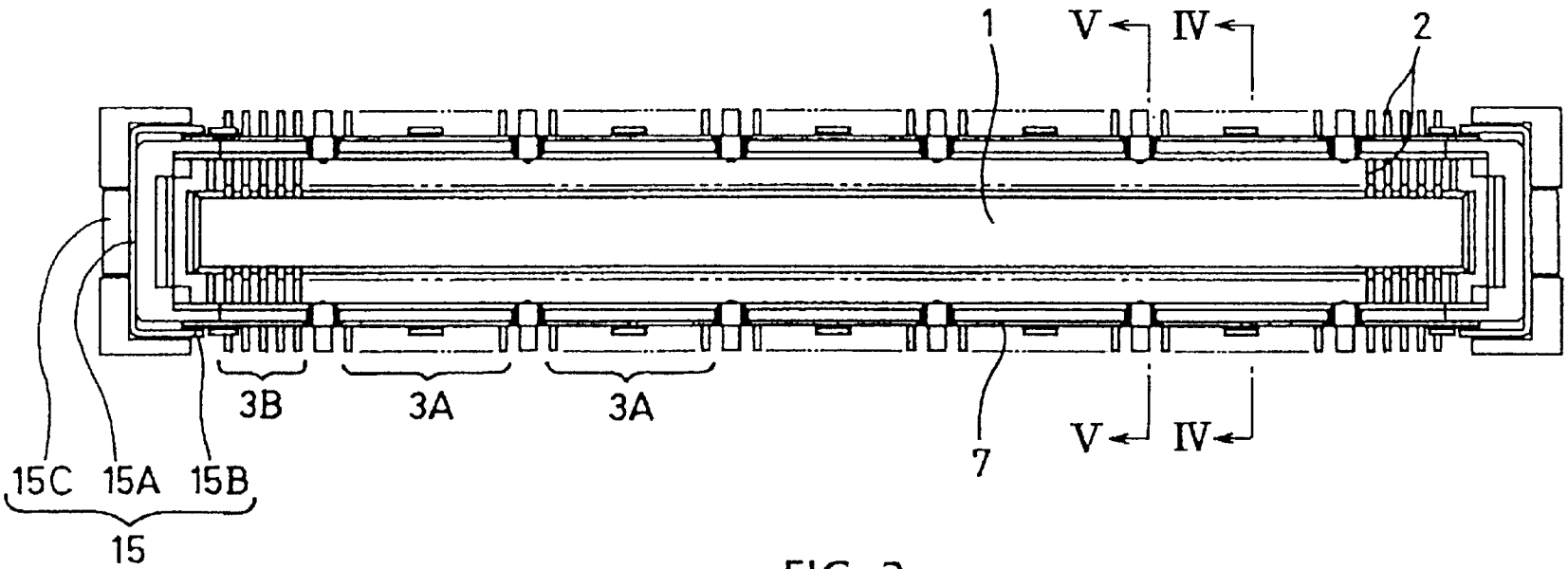
FIG. 2 is a top view of the connector of FIG. 1.

In FIGS. 1 and 2, an electrical connector according to the invention comprises an insulative housing 1 of an rectangular paralellepiped and a plurality of contact elements 2 installed in a row in the housing 1.

Figure 4:
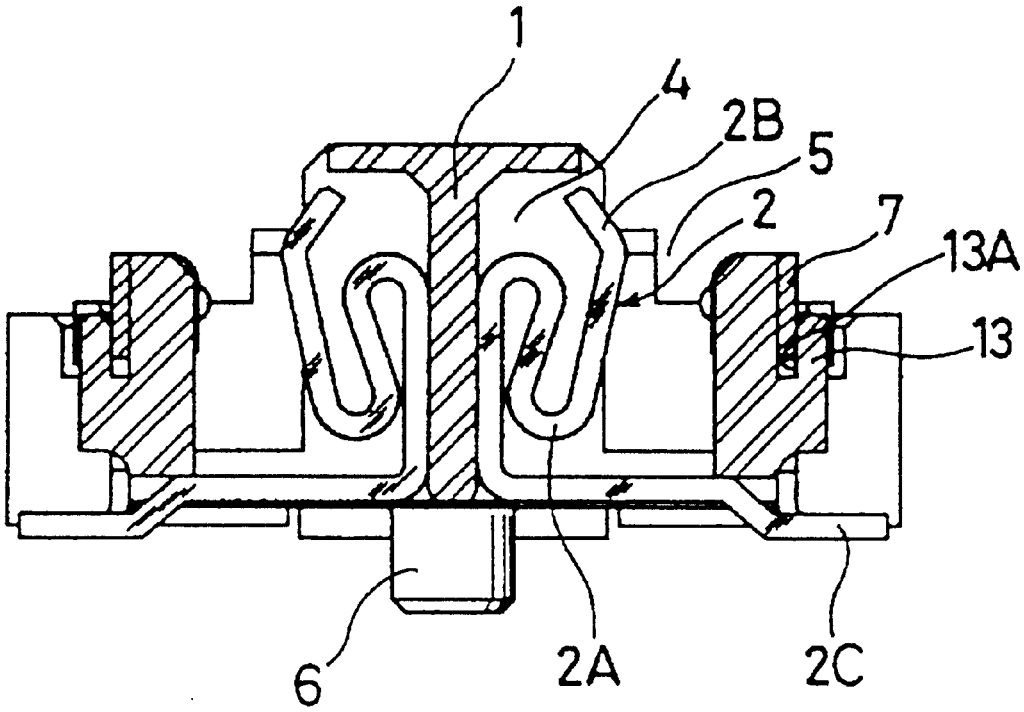
FIG. 4 is a sectional view taken along the line IV—IV in Fig.2.

The contact elements 2 are installed on the both sides of the housing 1 in a plurality of groups 3A and 3B (in this case there are seven groups on each side). The groups 3B provided on the both ends include approximately a half of contact elements 2 of the five groups 3A provided in the middle. As shown in FIG. 4, the contact elements 2 are housed in a plurality of accommodation grooves 4 provided in the housing 1. Each contact element 2 has an S-shaped spring section 2A provided in the middle thereof, a contact section 2B on one end thereof and a connection section 2C on the other end projecting outside the housing 1. The accommodation grooves 4 are opened to an upper and lower outside corners. The contact elements 2 are inserted into the accommodation grooves 4 from the lower opening. The contact section 2B faces the upper opening and the connection section 3C projects outwardly from the bottom of the housing 1. The accommodation grooves 4 communicate with each other at the upper opening forming an accommodation space 5 where a mating connector is inserted. A cylindrical leg 6 extends downwardly from the bottom of the housing 1 for attaching the housing 1 to a circuit board.

Figure 3:
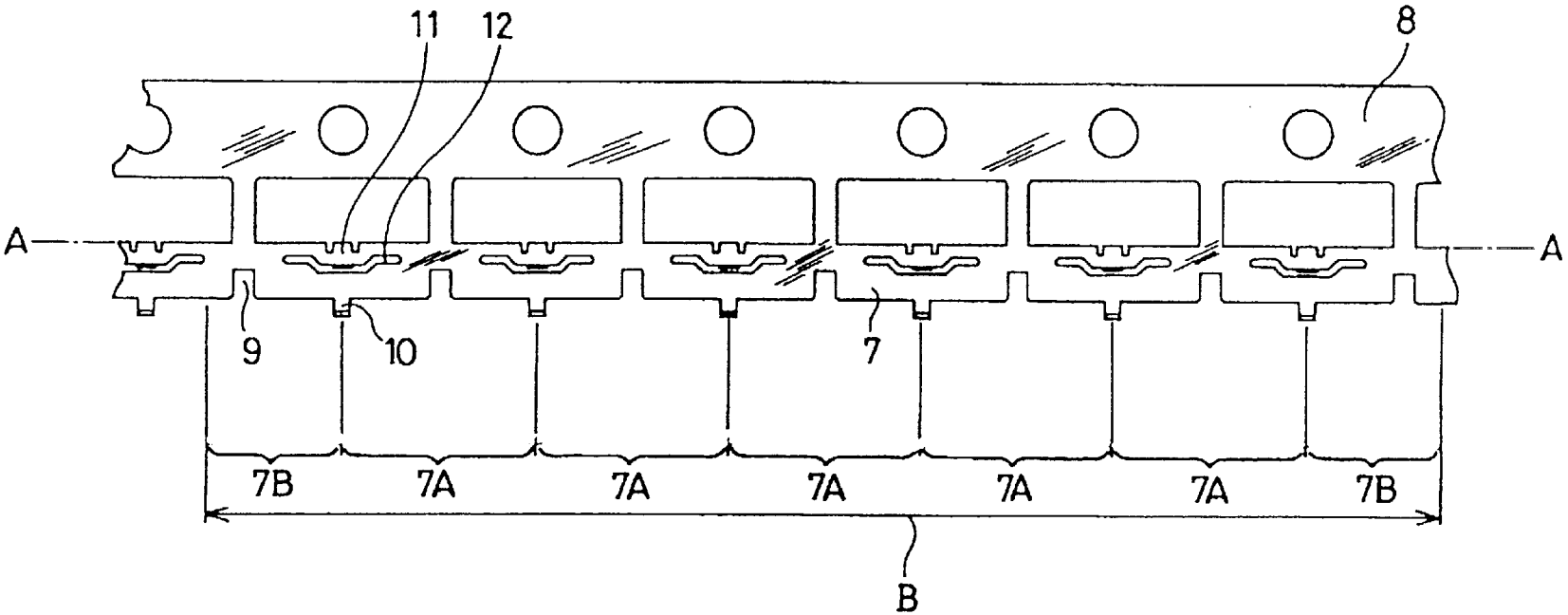
FIG. 3 shows a semi-finished material for the shield plate shown in FIG. 1 before the carrier is cut off.

A pair of shield plates 7 are provided on opposite sides of the housing 1 so as to extend in the longitudinal direction of the housing 1. As shown in FIG. 3, the shield plate 7 is made by press-punching and bending a strip of metal so as to be integrated with a carrier 8 as a unit for facilitating automatic assembly. The carrier 8 is cut off from the shield plate 7 at the A—A line, and the shield plate 7 is cut to the predetermined length B that corresponds to the length of the housing 1 before assembled in the housing 1.

Figure 5:
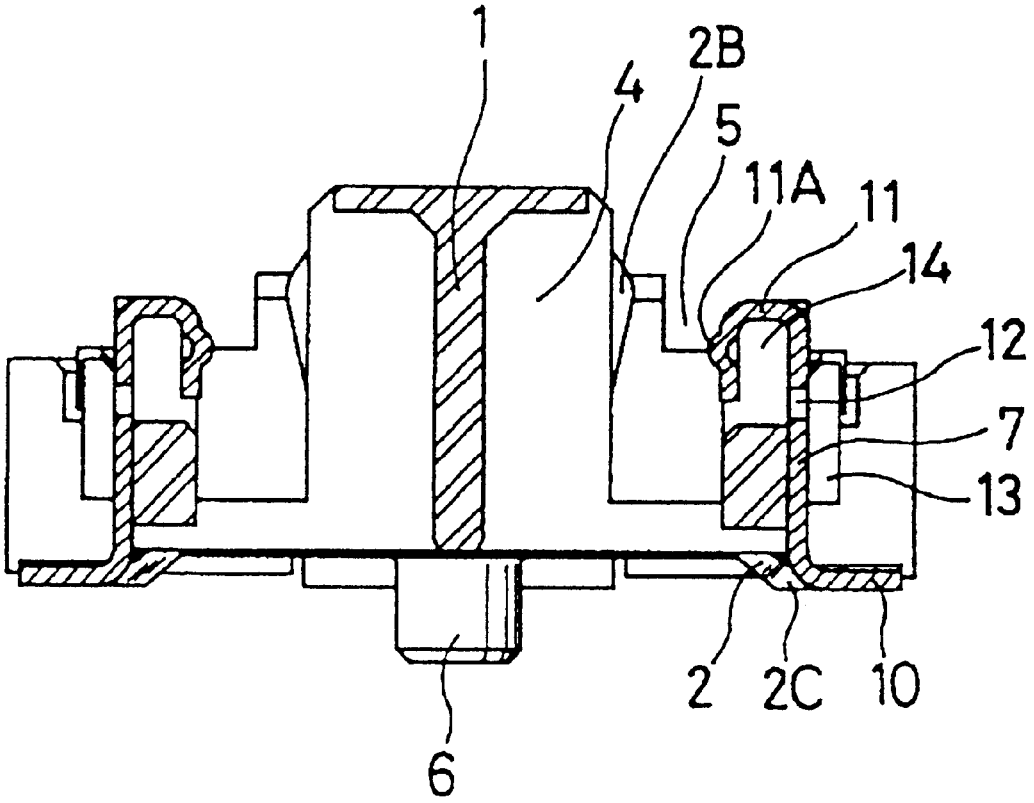
FIG. 5 is a sectional view taken along the line V—V in FIG. 2.

The shield plate 7 has a plurality of fitting recesses 9, a plurality of ground sections 10 and a plurality of contact tongues 11. The fitting recesses 9 for fitting the shield plate 7 to the housing 1 are provided with the pitch equal to the pitch with which the five groups 3A of the contact elements 2 are provided. The ground sections 10 are provided on the lower end of the plate 7 between the fitting recesses. The contact tongues 11 are provided on the upper end of the plate 7 at positions corresponding to the ground sections 10. A plurality of windows 12 are provided near the contact tongues 11 extending in the longitudinal direction of the plate 7. As shown in FIG. 5; the ground section 10 is bent so that a tip thereof extends in the direction away from the housing 1. The contact tongue 11 extends toward the housing 1 and is bent to form a reverse U-shape. The contact tongue 11 has a dimple or a hemisphere 11A which extends toward the inside of the housing 1. A dimpled surface of the contact tongue 11 is flexible with respect to a base section of the tongue 11 since the tongue 11 is U-shaped. In addition, the base section itself is flexible because of the window 12 provided in the adjacent areas. Therefore, the contact tongue 11 has spring properties at two places.

When the shield plate 7 is cut to the predetermined length, the cut position is determined such that the plate 7 has seven areas corresponding to the seven groups of the contact elements 2. Five areas 7A out of the seven are provided in the middle of the shield plate 7 and each of the five areas has a width equal to the width between two ground sections 10. The remaining two areas 7B are provided at the both ends of the shield plate 7, and each of the areas 7B has approximately a half width of the area 7A.

The shield plate 7 is attached to the housing 1 after cut to the predetermined length B. The attachment is made by engaging the fitting recesses 9 with an engaging groove 13A formed around projections 13 provided on the side of the housing 1. As shown in FIG. 5, the contact tongues 11 are housed in accommodation sections 14 formed at corresponding positions of the housing 1. The dimples 11A project to the inside of the accommodation space 5.

A pair of reinforcing plates 15 are provided on the longitudinal ends of the housing 1. As shown in FIG. 2, the reinforcing plates 15 are made by bending a metal plate to C-shape. The reinforcing plate 15 has a main part 15A facing the end of the housing 1 and a pair of auxiliary parts 15B extending from the main part and bending toward the side of the housing 1. The auxiliary parts 15B are flexible in the direction of plate thickness. The parts 15B partially overlaps the end of the shield plate 7 and hold the shield plate 7 with the spring force. Thus, the housing 1 is shielded by the shield plates 7 and the reinforcing plates 15 at the four sides.

Figure 6:
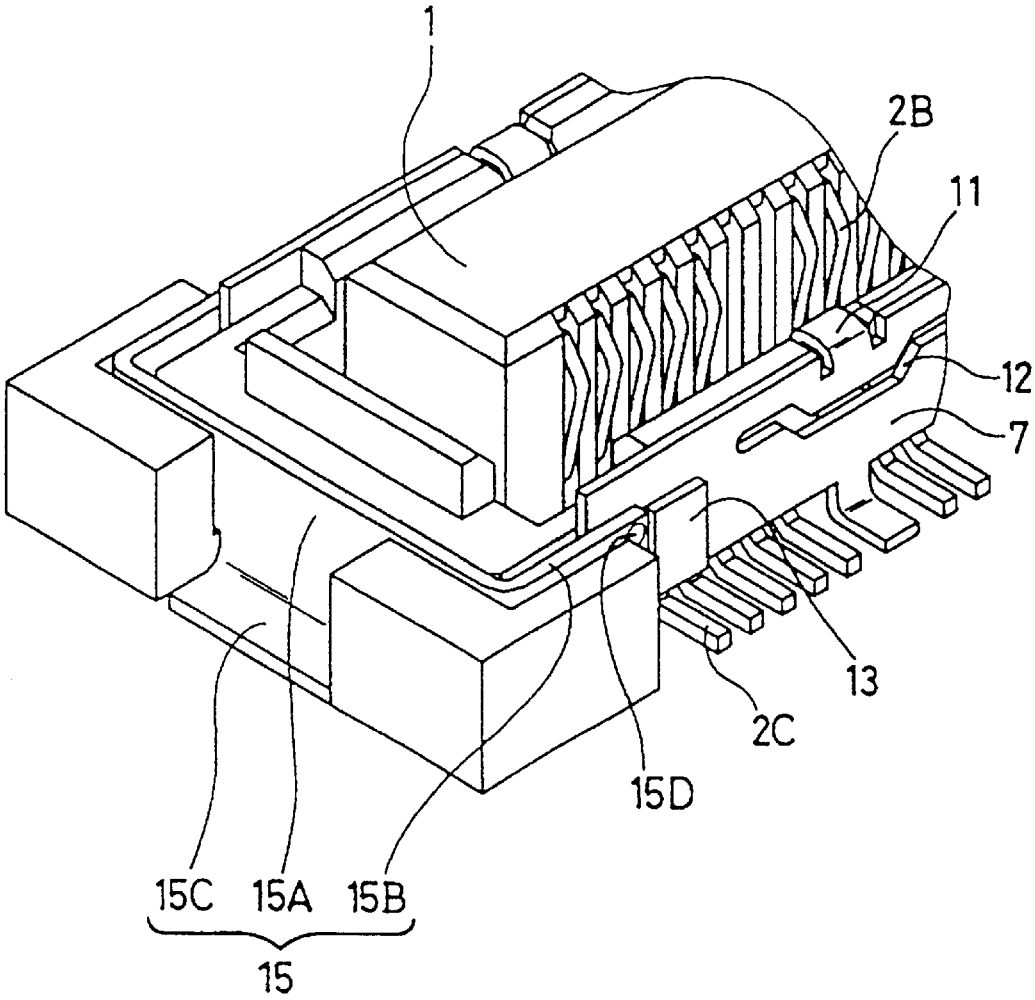
FIG. 6 is a perspective view of a neighboring area of the end of a connector.

As shown in FIG. 6, it is preferable that the reinforcing plate 15 has a dimple or hemisphere 15D on the auxiliary part 15B facing the shield plate 7. The reinforcing plate 15 further has a fixing leg 15C formed at the position corresponding to the end of the housing 1 so as to extend in the direction away from the housing 1. The fixing leg 15C is located slightly lower than the bottom of the housing 1 and in substantially the same plane of the ground sections 10 of the shield plate 7 and the connection sections 2C of the contact elements 2.

As described above, the shield plate 7 having the carrier 8 is cut to the predetermined length B, and the carrier 8 is cut off before the shield plate 7 is attached to the housing 1. The shield plate 7 before attachment to the housing 1 has a series of patterns which correspond to the groups 3A and 3B of the contact elements 2. If the number of groups of the contact elements 2 is changed, the length B is changed accordingly. The shield plate 7 is attached to the housing 1 by inserting the fitting recesses 9 into the engaging grooves 13A provided along the side of the housing 1. Therefore, the longitudinal position of the shield plate 7 is determined only by the engagement. The relative positions of the fitting recesses 9 and the ground sections 10 are accurate because the both are simultaneously made in a press. The relative positions of the projections 13 engaging with the fitting recesses 9 and contact elements 2 received in the accommodation grooves 4 are accurate because the projections 13 and the accommodation grooves 4 are formed in the housing 1 by the same molding process. Accordingly, the relative positions of the contact elements 2 and the ground sections 10 are so accurate that there is no problem even if the both members are provided very closely.

Even if there is an error in the bent position of the auxiliary parts 15B when the auxiliary parts 15B of the reinforcing plate 15 are brought into contact with the shield plate 7, the error has no influence on the fitting position of the shield plate 7 so that the relative positions of the contact elements 2 and the ground sections 10 of the shield plate 7 remain accurate.

The connector thus produced is attached to a circuit board (not shown). The connector is attached to the predetermined position of the circuit board by inserting the leg 6 of the housing 1 into an alignment hole provided in the circuit board. Then, the connection sections 2C of the contact elements 2 and the ground sections 10 of the shield plate 7 are soldered to the corresponding circuit and ground traces of the circuit board. In addition, the fixing legs 15C of the reinforcing plates 15 are soldered to the corresponding parts on the circuit board.

Figure 7:
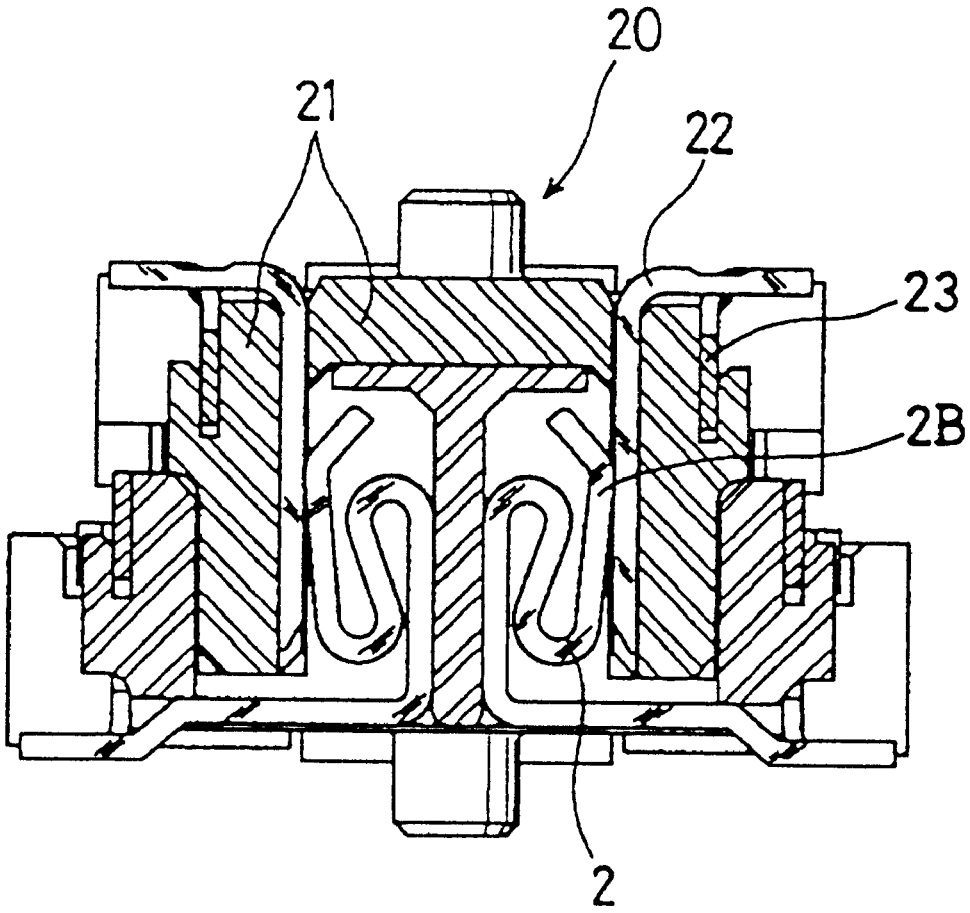
FIG. 7 is a sectional view taken at the same position as FIG. 4 to show the connector of FIG. 1 engaging with a mating connector.
Figure 8:
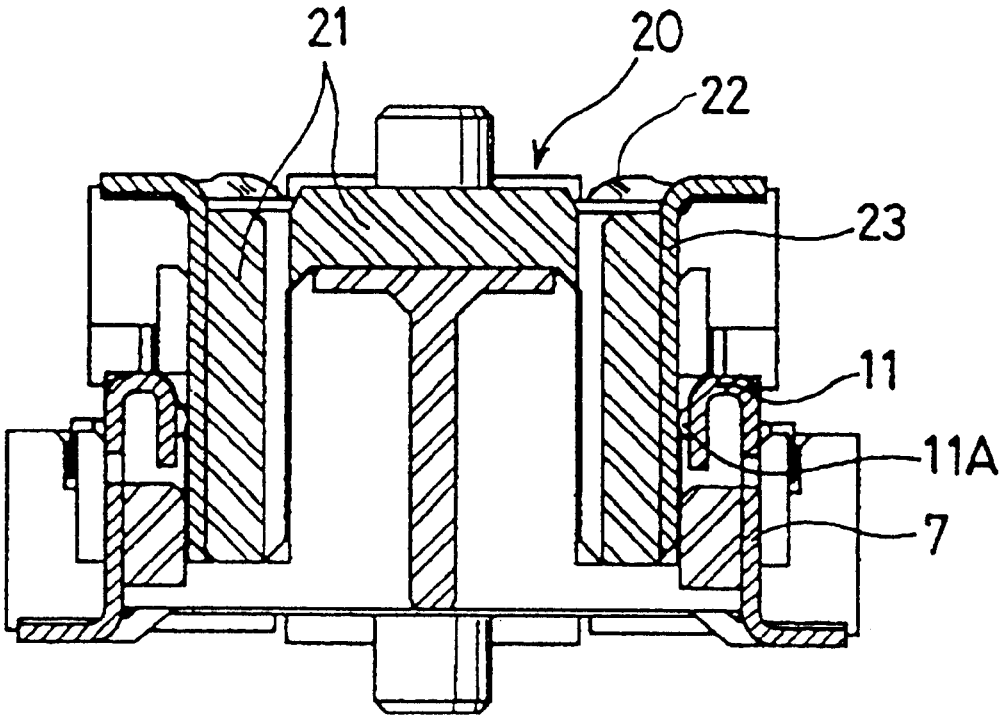
FIG. 8 is a sectional view taken at the same position as FIG. 5 to show the connector of FIG. 1 engaging with a mating connector.

The connector described above is connected to a mating connector 20 as shown in FIGS. 7 and 8. The FIGS. 7 and 8 are cross-sectional views corresponding to FIGS. 4 and 5 respectively. The mating connector 20 comprises a plurality of contact elements 22 provided in a housing 21 and a plurality of shield plates 23 provided on the sides of the housing 21.

When the mating connector 20 is inserted into the connector according to the invention, the contact sections 2B of the contact elements 2 and the contact tongues of the shield plates 7, especially the dimples 11A of the contact tongues 11 are brought into contact with the contact elements 22 and the shield plates 23 of the mating connector 20, respectively.

When the dimples 11A are brought into contact with the shield plate 23 of the mating connector, the contact tongues 11 are so flexible owing to the spring property between the contact tongue 11 and the window 12 and the spring property of the contact tongues 11 themselves that the dimples 11 are brought into firm contact with the shield plate 23 of the mating connector.

This invention is not limited to the embodiment shown in FIGS. 1 to 8, and a variety of modifications are possible.

Figure 9:
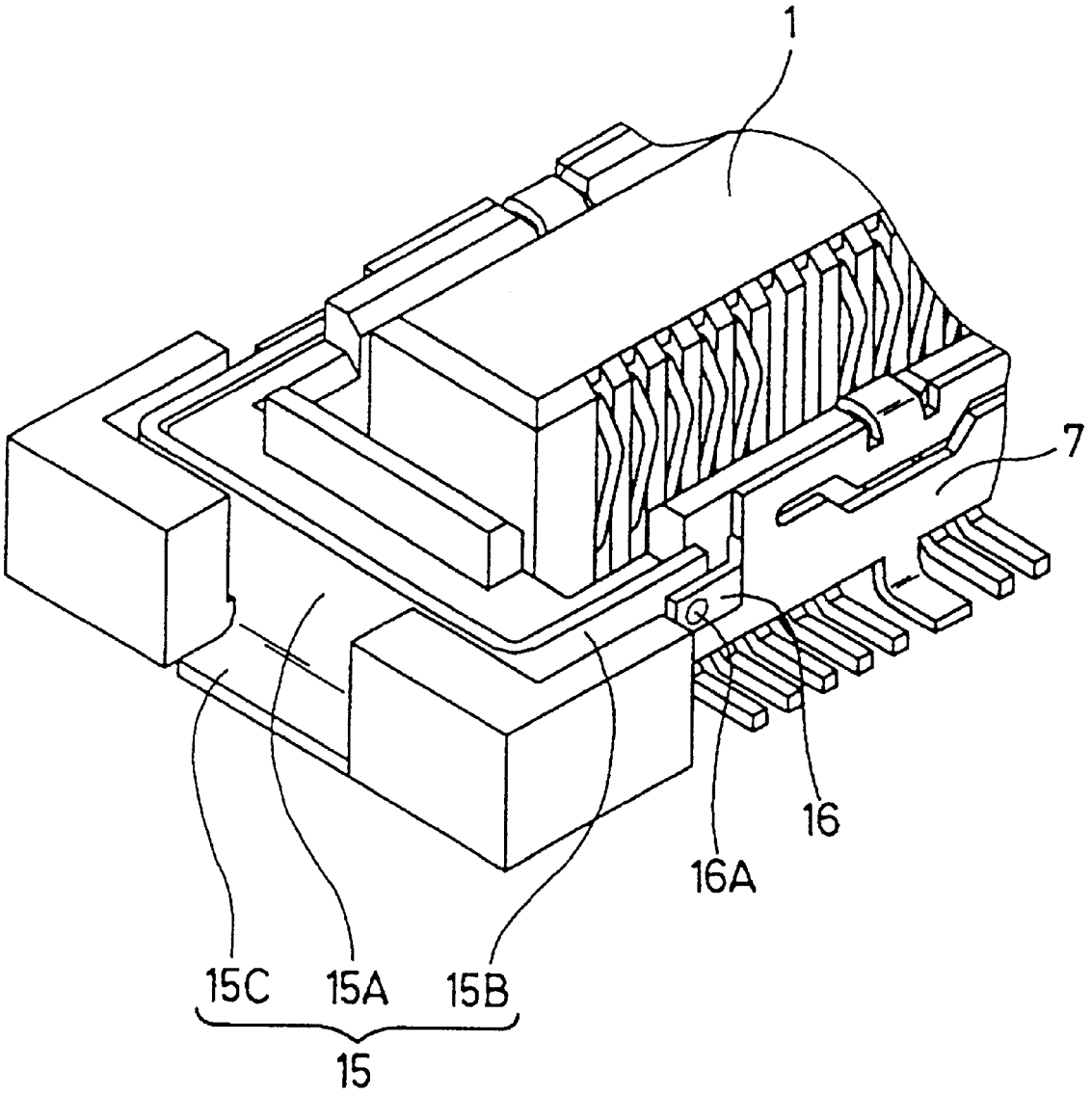
FIG. 9 is a perspective view of an end portion of a connector according to the second embodiment of the invention.

For example, as shown in FIG. 9, a spring arm 16 is provided on the end of the shield plate 7 with a small space left between the spring arm 16 and the side of the housing 1. The spring arm 16 biases the auxiliary portion 15B of the reinforcing plate 15 to thereby make contact with the reinforcing plate 15. It is preferable to provide a dimple 16A on the spring arm 16 which contacts the auxiliary portion 15B.

Figure 10:
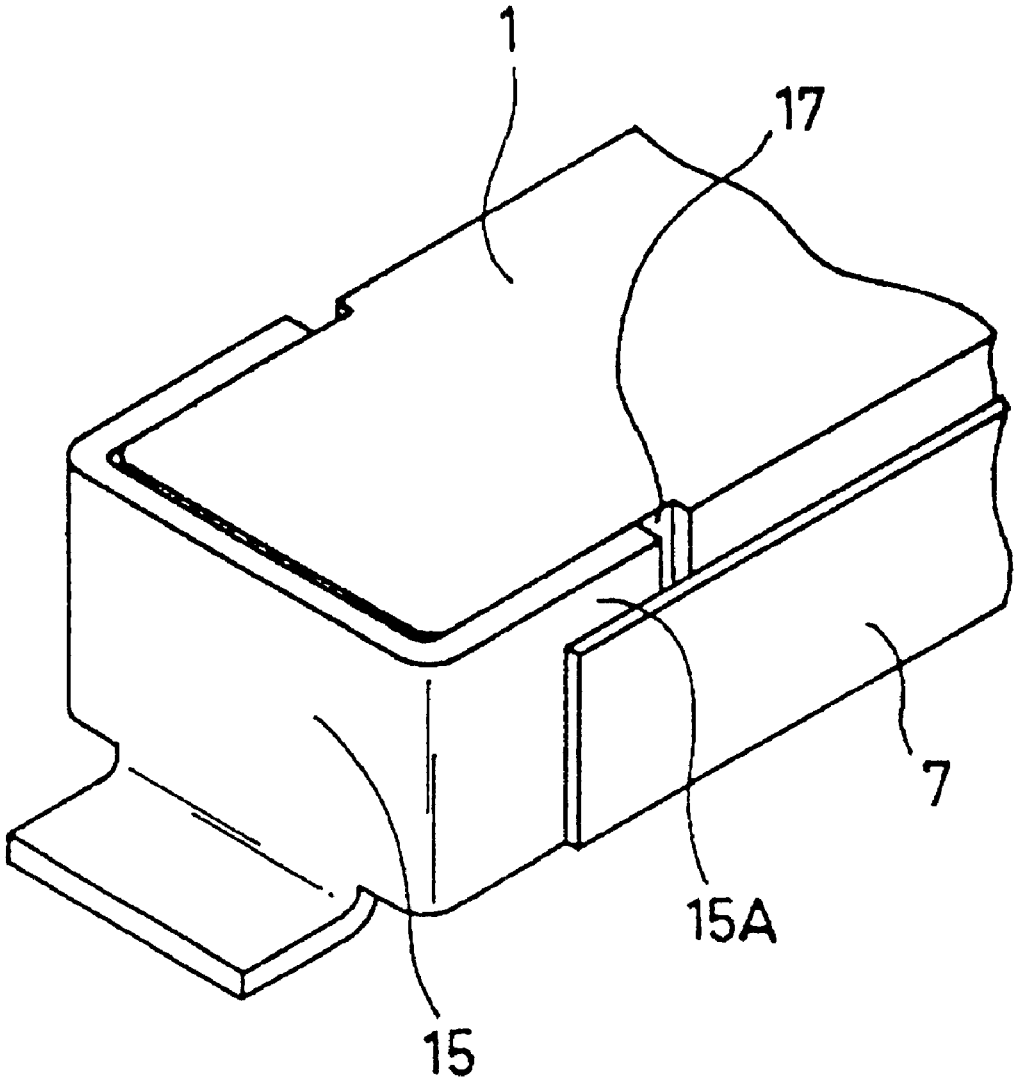
FIG. 10 is a perspective view of an end portion of a connector according to the third embodiment of the invention.

Alternatively, as shown in FIG. 10, a step 17 is provided in the housing 1 with a height less than the thickness of the reinforcing plates 15 so as to accommodate the auxiliary portion 15B of the reinforcing plates 15. The shield plate 7 flexes by a distance equal to the difference between the height of step 17 and the thickness of the reinforcing plates 15 and firmly contacts the auxiliary portion 15B of the reinforcing plates 15.

Figure 11:
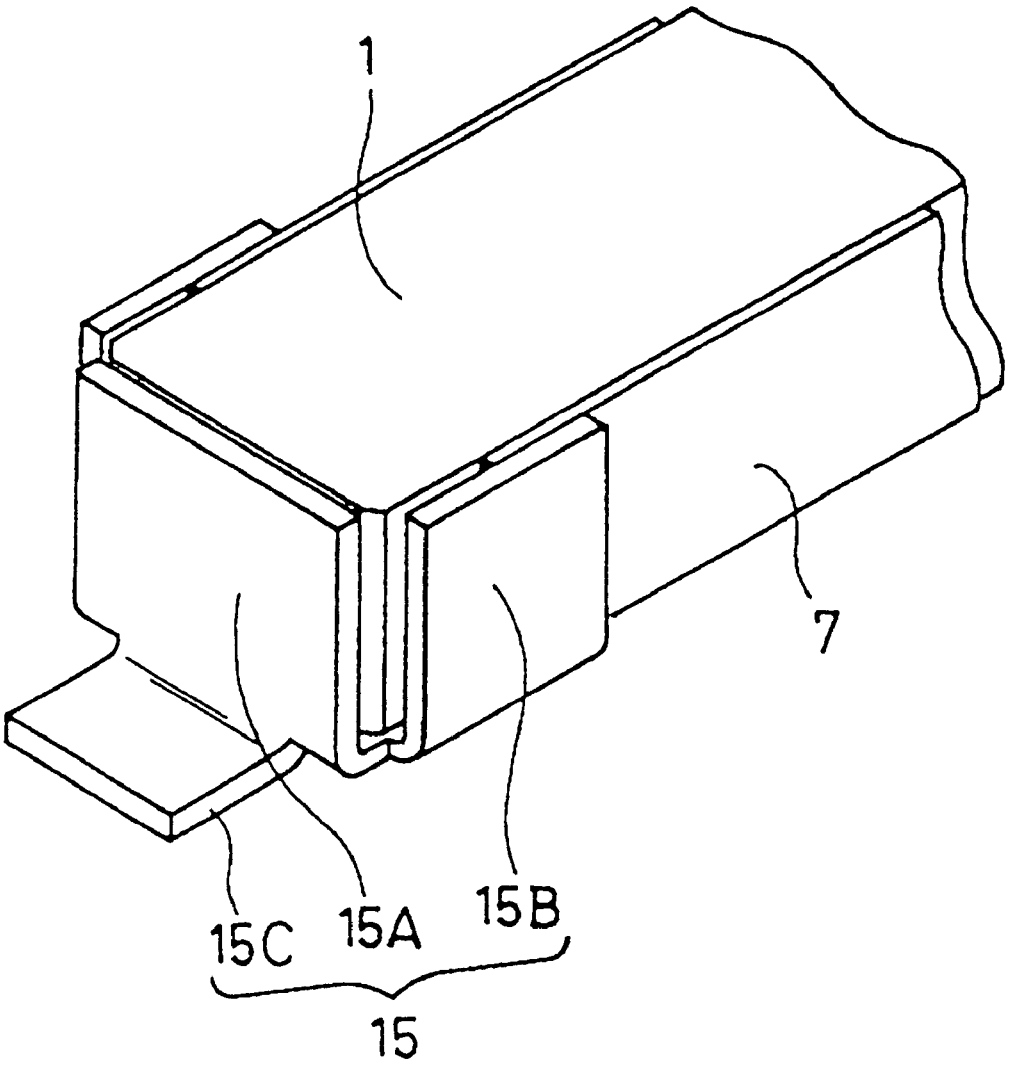
FIG. 11 is a perspective view of an end portion of a connector according to the fourth embodiment of the invention.

In addition, as shown in FIG. 11, the main part 15A and the auxiliary part 15B of the reinforcing plate 15 are connected at the bottom instead of the side.

Figure 12:
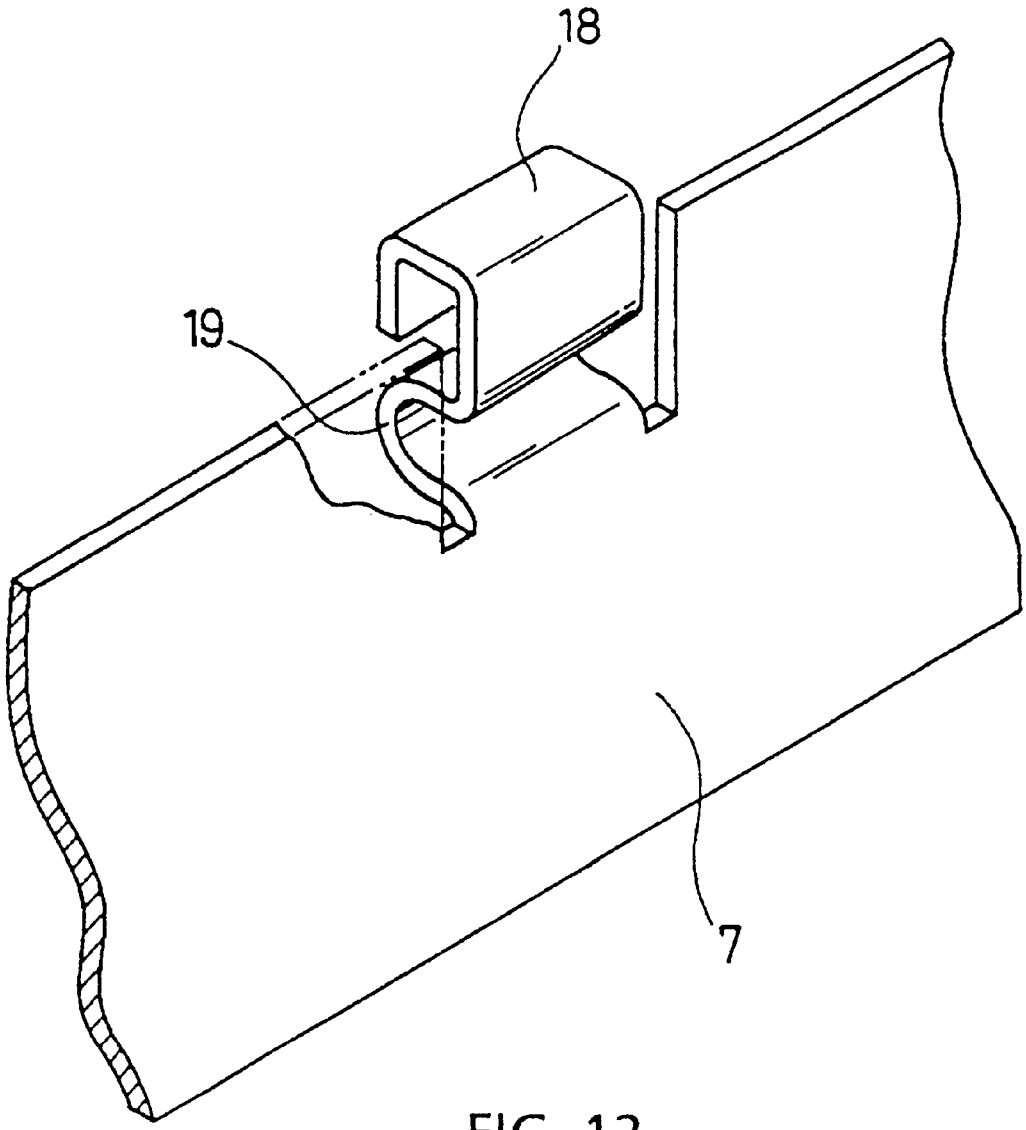
FIG. 12 is a perspective view of a portion of the shield plate according to the fifth embodiment of the invention.

Further, as shown in FIG. 12, a curved portion 19 is provided at the base of a contact tongue 18 instead of providing the window 12 so as to provide a spring property in addition to the spring property of the reverse U-shaped part of the contact tongue 18.

As fully described above, according to the first embodiment of the invention, the relative positions of the ground sections of a shield plate and the contact elements are so accurate, regardless of preciseness of the bent position of the reinforcing plate, that it is possible to provide high-density arrangement of a large number of contact elements in the miniature connector. In addition, the shield plate is made by using the same semi-finished material according to the number of contact elements included so that it is possible to use the same press dice, thereby reducing the costs of manufacture of a variety of connectors.

According to the second embodiment of the invention, the contact tongue of a shield plate is flexible at two positions, thus providing a large amount of flexure of the contact tongue and a firm contact with the shield section of a mating connector.

What is claimed is:

1. An electrical connector, comprising:

an insulative housing of a rectangular parallelepiped;

a plurality of contact elements provided on both sides of said housing;

a pair of shield plates provided on longitudinal sides of said housing; and a pair of reinforcing plates provided on opposite ends of said housing and having end portions in contact with end portions of said shield plate, wherein said shield plate is positioned within a length of said longitudinal side of said housing; and each of said reinforcing plates has a main part positioned at said end of said housing and an auxiliary part extending in parallel with a side surface of said shield plate so that said auxiliary part overlaps said end portion of said shield plate and makes spring contact with said shield plate.

* * * * *